US006192862B1

(12) United States Patent
Tanabe et al.

(10) Patent No.: US 6,192,862 B1
(45) Date of Patent: Feb. 27, 2001

(54) ACCUMULATOR TYPE FUEL INJECTION SYSTEM

(75) Inventors: Keiki Tanabe, Yokohama; Susumu Kohketsu, Tokyo, both of (JP)

(73) Assignee: Mitsubishi Jidosha Kogyo Kabushiki Kaisha (JP)

( * ) Notice: Subject to any disclaimer, the term of this patent is extended or adjusted under 35 U.S.C. 154(b) by 0 days.

(21) Appl. No.: 09/444,354

(22) Filed: Nov. 18, 1999

(30) Foreign Application Priority Data

Nov. 19, 1998 (JP) ..... 10-329238
Nov. 19, 1998 (JP) ..... 10-329239

(51) Int. Cl.[7] ..... F02M 7/00
(52) U.S. Cl. ..... 123/447
(58) Field of Search ..... 123/446, 447, 123/506, 299–300

(56) References Cited

U.S. PATENT DOCUMENTS 5,642,714 * 7/1997 Buckley ..... 123/447
5,732,679 * 3/1998 Takahasi et al. ..... 123/447
6,092,509 * 7/2000 Tanabe et al. ..... 123/447
6,112,721 * 9/2000 Kouketsu et al. ..... 123/447

* cited by examiner

*Primary Examiner*—Thomas N. Moulis
(74) *Attorney, Agent, or Firm*—Rossi & Associates

(57) ABSTRACT

After an engine has been started, a controller 8 of a fuel injection system opens an injection rate switching change-over valve 5 for a period of time not less than a fuel injection period until the time a fuel pressure in a low pressure accumulator 4 connected to the portion of a fuel passage 10*a* which is on the downstream side of the change-over valve 5 has reached a set level, whereby a fuel injection starting delay ascribed to a fuel pressure decrease in the second accumulator can be prevented. After the engine has been started, the controller 8 of the fuel injection system sets the change-over valve opening starting time in each fuel injection cycle to the time earlier than the injector opening starting time, or the opening starting time of both an injector and change-over valve to the time earlier than those in a regular mode until the time the fuel pressure in the low-pressure accumulator 4 connected to the portion of the fuel passage 10*a* which is on the downstream side of the injection rate switching change-over valve 5 has reached the set level, whereby the fuel injection starting delay can be prevented. Therefore, the engine starting characteristics are improved, and the discharging of white smoke from the engine is prevented.

24 Claims, 9 Drawing Sheets

ACCUMULATOR TYPE FUEL INJECTION SYSTEM

FIELD OF THE INVENTION

This invention relates to an accumulator type fuel injection system.

BACKGROUND OF THE INVENTION

An accumulator type fuel injection system is known which is adapted to stably supply a high-pressure fuel stored in an accumulator into each cylinder of a diesel engine, and enable the engine performance to be improved in a wide operating range thereof. However, when a fuel injection rate immediately after the starting of a fuel injection operation is excessively high even in such a fuel injection system, a sudden explosion combustion is carried out in an initial stage of combustion, and not only operating noise of the engine but also the NOx content of an exhaust gas increases.

To eliminate such inconveniences, an accumulator type fuel injection system adapted to inject a fuel at a lower injection rate in an initial stage of each fuel injection cycle has been proposed. This proposed system is provided with, for example, a low-pressure accumulator adapted to store a low-pressure fuel, a high-pressure accumulator adapted to accumulate a high-pressure fuel, a change-over valve adapted to selectively communicate the low-pressure accumulator or the high-pressure accumulator with an injector (fuel injection nozzle) and thereby switch an injection rate, and a switch valve adapted to communicate and shut off a control chamber of the injector with and from a fuel tank and thereby control the injection time.

Regarding the formation of a fuel pressure in an accumulator, there are, for example, an accumulator adapted to obtain low-pressure and high-pressure fuels by using a low-pressure pump and a high-pressure pump which are driven by an engine, and an accumulator (Japanese Patent Laid-Open No. 93936/1994) adapted to obtain a high-pressure fuel by using a high-pressure pump, and a low-pressure fuel by regulating the pressure of the high-pressure fuel introduced into a low-pressure accumulator.

In the accumulator type fuel injection system disclosed in International Patent Laid-Open No. WO98/09068, which is adapted to obtain a low-pressure fuel of a low-pressure accumulator from a high-pressure fuel of a high-pressure accumulator, for example, a fuel passage by which a change-over valve and a fuel chamber of an injector are connected together is filled with a low-pressure fuel by closing both an injection time control switch valve and an injection rate change-over valve, and the injector is maintained in a valve-closed state by supplying the low-pressure fuel to a control chamber of the injector which communicates with the fuel passage. At the arrival of the injection starting time, the switch valve is opened to discharge the low-pressure fuel in the control chamber to a fuel tank, whereby a valve of the injector is opened to carry out initial low-pressure injection (which will hereinafter be referred to as low-pressure injection). When the low-pressure injection period has elapsed, the change-over valve is opened to carry out main high-pressure injection (which will hereinafter be referred to as high-pressure injection) by injecting the high-pressure fuel in the high-pressure accumulator from a nozzle. At the arrival of the injection finishing time, the change-over valve is closed. In the low-pressure accumulator, a low-pressure fuel is obtained by regulating the pressure of the high-pressure fuel flowing from the fuel passage thereinto. In such an accumulator type fuel injection system, the fuel in the fuel passage gradually flows out when the engine is stopped, via a clearance around a plunger of a high-pressure pump and a clearance around the control chamber of the injector, and the fuel pressure in the fuel passage and low-pressure accumulator decreases to a level corresponding to that of the atmosphere.

When the cranking is done at a subsequent engine starting time, a pressurized fuel is supplied from the high-pressure pump to the high-pressure accumulator, and the injection rate switching control change-over valve and injection time control switch valve are opened and closed so as to carry out low-pressure injection and high-pressure injection. When the pressurized fuel is discharged from the high-pressure accumulator during a high-pressure injection period, the fuel pressure therein decreases correspondingly, and the formation of a fuel pressure in the high-pressure accumulator tends to be delayed immediately after the starting of the engine. Consequently, the formation of a fuel pressure in the low-pressure accumulator is delayed.

Therefore, it is difficult immediately after the starting of the engine to obtain a low-pressure fuel of a predetermined pressure exceeding a valve opening pressure of the injector. The low-pressure injection is not executed until a fuel pressure in the low-pressure accumulator has reached a predetermined level, and the fuel injection starting time is delayed, so that inconveniences, such as imperfect starting of the engine and the discharging of white smoke occur.

SUMMARY OF THE INVENTION

Therefore, the present invention aims at providing an accumulator type fuel injection system adapted to carry out early a fuel injection operation in a regular mode in which high-pressure injection is carried out immediately after low-pressure injection in each fuel injection cycle, by promoting the formation of a fuel pressure in a low-pressure accumulator at the engine starting time, or by rationalizing the fuel injection starting time at the engine starting time at which the formation of a fuel pressure in the low-pressure accumulator is insufficient.

An accumulator type fuel injection system is characterized in that it comprises a first accumulator adapted to store a high-pressure fuel pressurized by a pump, a second accumulator connected to the portion of a fuel passage which is on the downstream side of a control valve for controlling the discharging of the high-pressure fuel in the first accumulator to a downstream side of the fuel passage, and adapted to store a low-pressure fuel, and a fuel control means for opening the control valve for a period of time longer than that, during which a fuel injection nozzle is opened, until a fuel pressure in the second accumulator has reached a set level after the start of the engine.

According to this accumulator type fuel injection system, when the fuel pressure in the second accumulator decreases at the engine starting time, the control valve is opened not only throughout a period of time during which the fuel injection nozzle is opened but also during at least a part of other period of time. Since the control valve is opened at the starting time of the period of time during which the nozzle is opened, the injection of the fuel from the first accumulator is carried out from an initial stage of the period of time during which the nozzle is opened, so that a fuel injection starting delay ascribed to the decrease in the fuel pressure in the second accumulator does not occur. Since the fuel in the first accumulator is capable of flowing into the second accumulator while the control valve is opened during a period of time other than that during which the nozzle is opened, the fuel pressure in the second accumulator can be increased positively, and a set pressure at which the injection of the fuel can be carried out is attained in a short period of time.

Preferably, the fuel control means continuously opens the control valve until the fuel pressure in the second accumulator has reached a set level. Owing to this operation, the control valve is kept open continuously irrespective of the opening and closure of the fuel injection nozzle, so that the fuel in the first accumulator is supplied continuously to the fuel passage. Therefore, the fuel pressure in the second accumulator can be increased positively during the whole of the period of time in which the fuel injection nozzle is opened, and the formation of a fuel pressure in the second accumulator is further promoted.

Preferably, the fuel control means opens the control valve in accordance with the opening of the fuel injection nozzle until the fuel pressure in the second accumulator has reached a set level, and closes the control valve later than the closing time of the fuel injection nozzle. Owing to this operation, the fuel pressure in the second accumulator can be increased positively between the time at which the fuel injection nozzle is closed and the time at which the control valve is closed. When the fuel pressure in the second accumulator reaches a set level, the fuel injection in a subsequent fuel injection cycle is carried out in a regular mode. In this stage in a preferred mode, the fuel pressure in the fuel passage decreases between the time at which the control valve is closed after the completion of the fuel injection cycle started at the time of attainment of a set pressure and the time at which a subsequent fuel injection cycle is started, so that low-pressure injection is carried out smoothly even in a fuel injection cycle executed for the first time after the fuel injection mode has been transferred to a regular fuel injection mode.

The fuel control means may set a fuel discharge pressure of the pump to a level higher than a set level of the fuel pressure in the first accumulator, whereby the pressure of the fuel discharged from the first accumulator to the fuel passage becomes high to enable the fuel pressure in the second accumulator to increase early.

The fuel control means may also maintain the idling condition of the engine in preference to a driver's accelerator pedal stepping operation until the fuel pressure in the second accumulator has reached a set level. At the start of an engine quipped with the fuel injection system according to the present invention, a fuel of a comparatively high pressure supplied from a first accumulator is injected. Therefore, there is the possibility that a combustion sound and the deterioration of the exhaust gas characteristics occur as compared with a case where fuel injection of a regular mode, in which high-pressure injection following low-pressure injection is done, is carried out. However, when the idling condition of the engine is maintained, the number of times of carrying out combustion until the fuel pressure in the second accumulator has reached a set level can be reduced, and the occurrence of a combustion sound and the deterioration of the exhaust gas characteristics can be prevented.

The accumulator type fuel injection system defined is characterized in that it is provided with a fuel control means adapted to open a control valve in agreement with or earlier than a target fuel injection starting time set in accordance with the operating condition of an engine, until the fuel pressure in a second accumulator, which is joined to the portion of a fuel passage which is on the downstream side of the control valve adapted to control the discharge of a high-pressure fuel in a first accumulator, and which stores a low-pressure fuel therein, has reached a predetermined level after the start of the engine.

According to this accumulator type fuel injection system, when the engine is started, the control valve is opened in agreement with or earlier than a target fuel injection starting time. When the fuel injection system is formed so that both a fuel injection nozzle and control valve are put in an opened state at the arrival of the target fuel injection starting time, the pressurized fuel in the first accumulator is supplied to the fuel injection nozzle at the arrival of the target fuel injection starting time via the opened control valve and fuel passage, and injected from the fuel injection nozzle. Therefore, unlike the case of a fuel injection system in which a control operation for opening a control valve later than a target fuel injection starting time by a length of a period of time of low-pressure injection is carried out from the time immediately after the starting of the cranking of the engine, a delay of fuel injection starting time does not occur after the starting of the engine in the system according to the present invention in which the opening time of the control valve is set to earlier. Accordingly, the engine starting characteristics are improved, and the discharging of white smoke from the engine is prevented.

Preferably, the fuel control means opens the fuel injection nozzle at the target fuel injection starting time, and the control valve at such time that is earlier than the target fuel injection starting time. Consequently, an opened condition of both the fuel injection nozzle and control valve is attained at the target fuel injection starting time. Therefore, when the engine is started, the fuel injection is started at planned time, and a delay of fuel injection starting time does not occur. In a fuel injection control operation at the starting of the engine, the controlling of the driving of the fuel injection nozzle can be carried out in the same manner as in a regular case. Accordingly, the controlling of the driving of the control valve only may be changed as compared with a control operation in a regular case, so that the contents of the control operation become simple. Since the time at which the control valve is opened is prior to that at which the fuel injection nozzle is opened, the supplying of the pressurized fuel from the first accumulator to the portion of the fuel passage which is on the downstream side of the control valve is done between the time at which the control valve is opened and that at which the fuel injection nozzle is opened, and the fuel injection at a sufficient fuel pressure is carried out simultaneously with the opening of the fuel injection nozzle.

Even when the fuel injection nozzle is opened at the time earlier than target fuel injection starting time with the control valve opened at the target fuel injection starting time in contrast with the above-described cases, both the fuel injection nozzle and control valve can be put in an opened state at the target fuel injection starting time. In this case, it is preferable that the contents of the control operation is simplified by setting the fuel injection nozzle opening time earlier by a length of period of time during which the low-pressure fuel injection is carried out.

Preferably, the predetermined pressure mentioned above is a pressure set in accordance with the operating condition of the engine. According to this preferred mode, the control valve is closed at a point in time at which the fuel injection nozzle is opened in each fuel injection cycle executed after the fuel pressure in the second accumulator has reached a predetermined level equal to a set level which suits the operating condition of the engine, so that the pressurized fuel of a set pressure already supplied from the second accumulator to the fuel injection nozzle is injected therefrom. Namely, low-pressure fuel injection is carried out. When a predetermined period of time has elapsed after the point in time at which the fuel injection nozzle was opened, with the control valve opened at the same time, the fuel in the first accumulator is injected from the fuel injection nozzle. Namely, high-pressure fuel injection is carried out. When a predetermined pressure, which constitutes a requirement for transferring the fuel injection mode to a regular fuel injection mode, is thus set equal to a set pressure, desired fuel injection comprising low-pressure injection and high-pressure injection can be carried out in each fuel injection cycle from the time immediately after the fuel pressure in the second accumulator has reached a predetermined level.

DETAILED DESCRIPTION OF THE PREFERRED EMBODIMENTS

The preferred embodiments of the present invention will now be described with reference to the drawings.

First, an accumulator type fuel injection system on which the present invention is based will be described.

Figure 1:
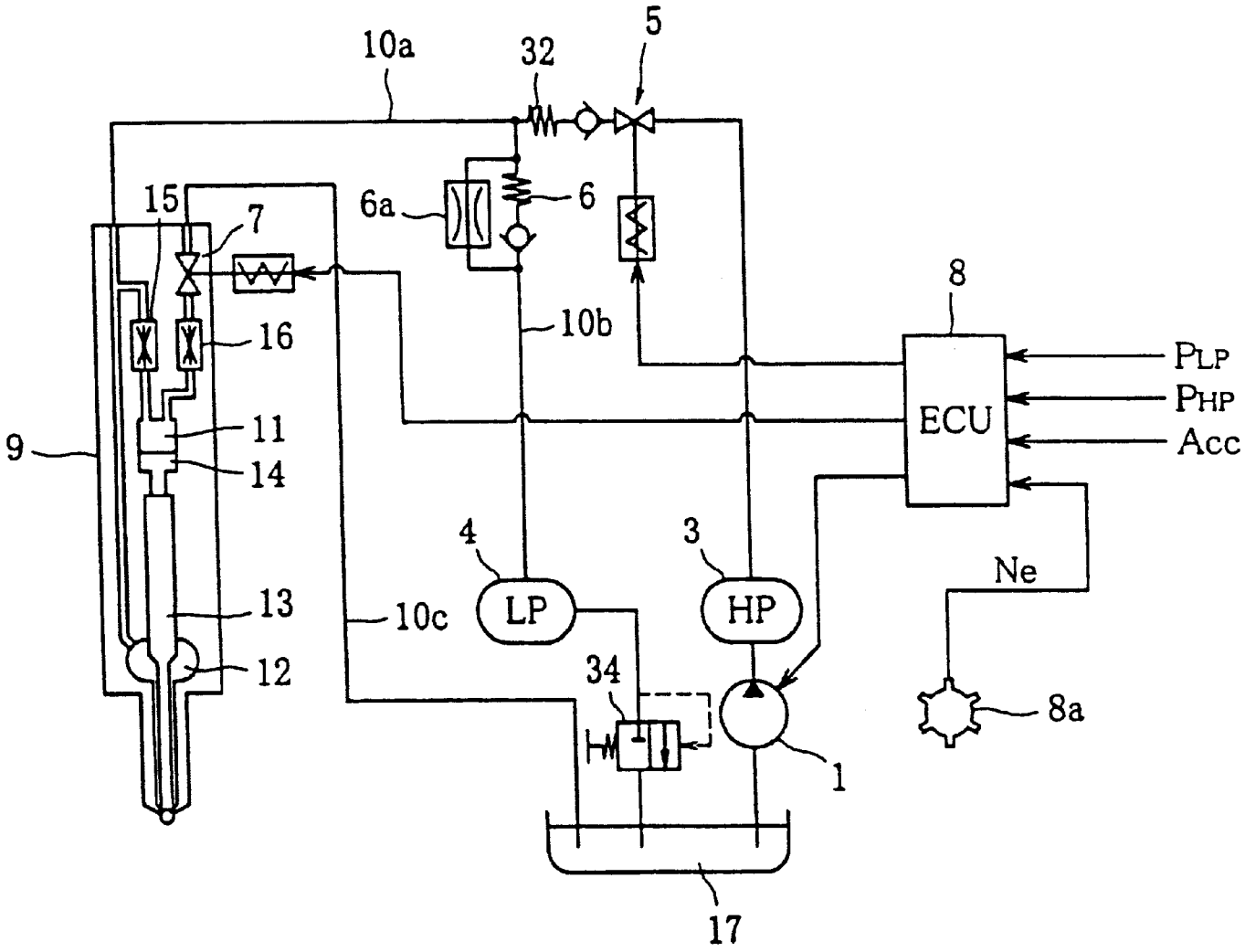
FIG. 1 is a schematic diagram showing an accumulator type fuel injection system on which the present invention is based.
Figure 2:
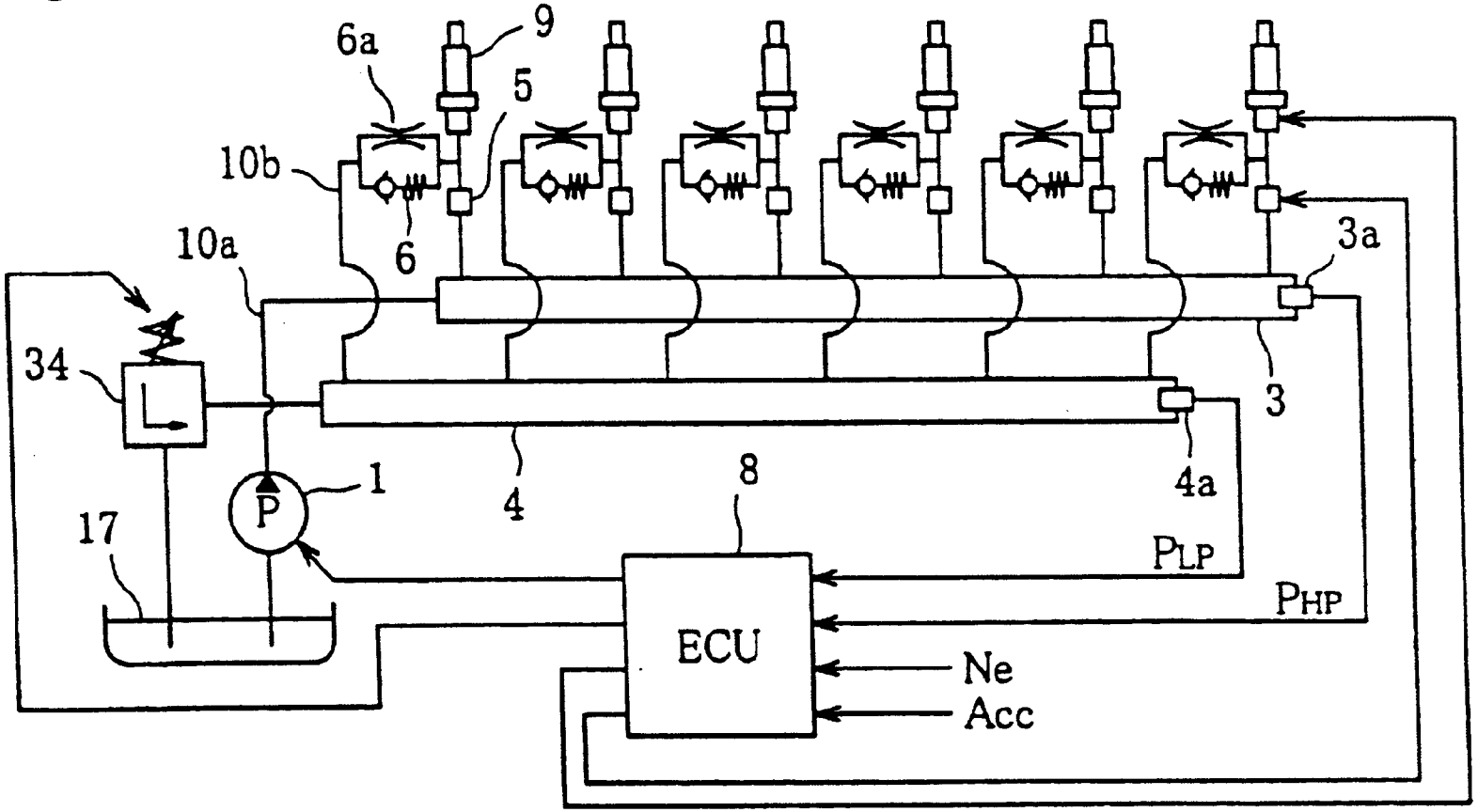
FIG. 2 is a schematic diagram showing the connection of a primary element of the fuel injection system shown in FIG. 1 and an injector for each cylinder of an engine.

An accumulator type fuel injection system is mounted on, for example, a 6-series-cylinder diesel engine (not shown), and provided with a high-pressure pump 1 as shown in FIGS. 1 and 2. The high-pressure pump 1 is driven by the engine and adapted to draw up a fuel in a fuel tank 17 and pressurized, and it comprises, for example, a displacement plunger pump, a fuel discharge pressure of which can be regulated by adjusting an effective section of its force feed stroke. The adjustment of the force feed stroke is made by regulating the closing time of, for example, an electromagnetic valve (not shown), and, while this electromagnetic valve is opened, a force feed operation becomes ineffective. In a 6-cylinder engine, a high-pressure pump is provided with, for example, two plungers. Each plunger has relation to three cylinders, and is adapted to make three force feed strokes while a high-pressure pump shaft revolves once.

A controller 8 in the accumulator type fuel injection system is adapted to variably regulate the force feed stroke of the pump 1 in accordance with an engine speed Ne detected by an engine speed sensor 8*a* and an accelerator pedal stepping amount (degree of opening of accelerator) $A_{CC}$ detected by a relative sensor (not shown), and make the force feed stroke (fuel pressure) feedback control in accordance with an actual pressure $P_{HP}$ in a high-pressure accumulator (first accumulator) 3 detected by a pressure sensor 3*a* (FIG. 2), whereby a high-pressure fuel which suits the operating condition of the engine is obtained.

The fuel pressurized by the pump 1 is stored in the high-pressure accumulator 3. This high-pressure accumulator 3 is common to all cylinders, and communicates with a fuel passage 10*a*. In intermediate portions of the fuel passage 10*a*, fuel injection rate switching change-over valves (control valves) 5 comprising, for example, two-way electromagnetic valves are provided for the respective cylinders. A check valve 32 is also provided in the portion of each fuel passage 10*a* which is on the immediate downstream side of the change-over valve 5.

A low-pressure accumulator (second accumulator) 4 common to all cylinders is connected to the fuel passages 10*a* via a fuel passage 10*b* branching from the portion of each fuel passage 10*a* which is on the downstream side of the check valves 32. A check valve 6 is provided in an intermediate portion of the fuel passage 10*b*, and a bypass fuel passage shunting the check valve 6 is added to the fuel passage 10*b*, an orifice 6*a* being provided in this bypass fuel passage. When the fuel pressure in the fuel passage 10*a* is higher than that in the fuel passage 10*b*, the fuel in the fuel passage 10*a* flows into the fuel passage 10*b* via the orifice 6*a*, and further into the low-pressure accumulator 4. Between the low-pressure accumulator 4 and fuel tank 17, a pressure control valve 34 is provided which is adapted to be operated under the control of a controller 8. Referring to FIG. 2, a reference numeral 4*a* denotes a pressure sensor for detecting a fuel pressure $P_{LP}$ in the low-pressure accumulator 4.

The controller 8 is adapted to control the pressure control valve 34 on the basis of an actual pressure $P_{LP}$ detected by the pressure sensor 4*a*, in such a manner that the fuel pressure in the low-pressure accumulator 4 attains a level which suits the operating condition of the engine represented by the engine speed Ne and stepping amount $A_{CC}$ of the accelerator pedal.

The injector (fuel injection nozzle) 9 for each cylinder of the engine has a control chamber 11 and a fuel chamber 12 which are connected to the fuel passage 10*a*, and the control chamber 11 is connected to the fuel tank 17 via a fuel return passage 10*c*. Reference numerals 15, 16 denote orifices. A reference numeral 7 denotes an injection time control switch valve provided in an intermediate portion of the fuel return passage 10*c* and comprising, for example, a two-way electromagnetic valve. This switch valve 7 may be incorporated in the injector.

The injector 9 has a needle valve 13 adapted to open and close a nozzle port thereof, and a hydraulic piston 14 provided movably in the control chamber 11, the needle valve 13 being urged toward the nozzle port by a spring (not shown). When the fuel is supplied from the fuel passage 10*a* to the control chamber 11 and fuel chamber 12 with the injection time control switch valve 7 closed, a resultant force of a resilient force of the spring and a fuel pressure is imparted to the needle valve 13 via the hydraulic piston 14, and the needle valve 13 closes the nozzle port against the fuel pressure in the fuel chamber 12.

When the switch valve 7 is opened to cause the fuel in the control chamber 11 to be discharged toward the fuel tank 17, the needle valve 13 is moved toward the hydraulic piston 14 against the resilient force of the spring owing to the fuel pressure in the fuel chamber 12 to open the nozzle port, so that the fuel in the fuel chamber 12 is injected into a combustion chamber (not shown) of the engine.

The operation in a regular mode of the fuel injection system of the above-described construction will now be described.

The fuel pressure in the high-pressure accumulator 3 and that in the low-pressure accumulator 4 are controlled under the control of the controller 8 so that these fuel pressures suit the operating condition of the engine, and a fuel injection time (fuel injection starting and finishing time) and a low-pressure injection period are set in accordance with the operating condition (engine speed and accelerator pedal stepping amount) of the engine.

Figure 3:
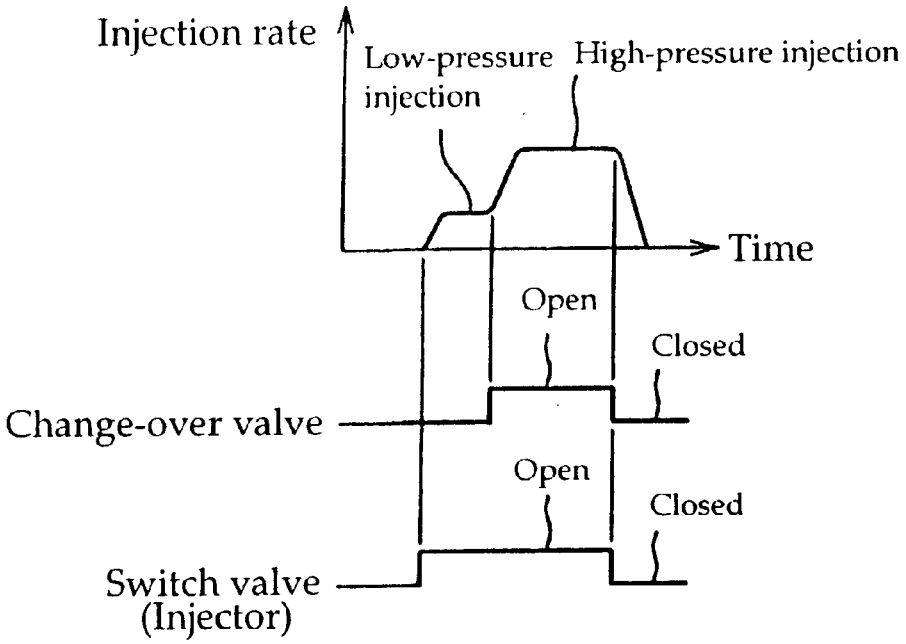
FIG. 3 is a diagram showing variation of an injection rate with the lapse of time in one fuel injection cycle executed in a regular mode, and variation of opened and closed condition of an injection rate switching change-over valve and an injection time control switch valve.

Until the arrival of the fuel injection starting time, the change-over valve 5 and switch valve 7 are all closed as shown in FIG. 3, and a low-pressure fuel is supplied from the low-pressure accumulator 4 to the portion of the fuel passage 10*a* which is on the downstream side of the change-over valve 5, this low-pressure fuel being supplied to the control chamber 11 and fuel chamber 12. Since the switch valve 7 is closed, the fuel pressure supplied to the interior of the control chamber 11 is applied to the needle valve 13 via the hydraulic piston 14, and the nozzle port of the injector 9 is closed with the needle valve 13.

When the fuel injection starting time has come, the switch valve 7 alone is opened, and the low-pressure fuel in the control chamber 11 drains away via the orifice 16 and fuel return passage 10*c*. When the resultant force of the fuel pressure imparted to the needle valve 13 via the hydraulic piston 14 and the resilient force of the spring has become smaller than the fuel pressure in the fuel chamber 12 which works so as to lift the needle valve 13, the needle valve 13 moves up to open the nozzle port, and the low-pressure fuel is injected from the injector 9. Namely, low-pressure initial injection at a comparatively low fuel injection rate (quantity of fuel injected per unit time) is carried out. Owing to this low-pressure injection, the quantity of fuel prior to ignition decreases to cause a premixed combustion rate to lower, so that the combustion in an initial stage of a fuel injection period is carried out comparatively slowly to contribute to the reduction of the NOx content of an exhaust gas.

When a predetermined period of time has elapsed after the start of the low-pressure injection, the injection rate switching change-over valve 5 is opened with the injection time control switch valve 7 kept open, and a high-pressure fuel is supplied to the fuel chamber 12 and injected from the injector 9. Namely, the fuel injection (high-pressure main injection) is executed at an injection rate higher than that at which the low-pressure injection is carried out.

Figure 8:
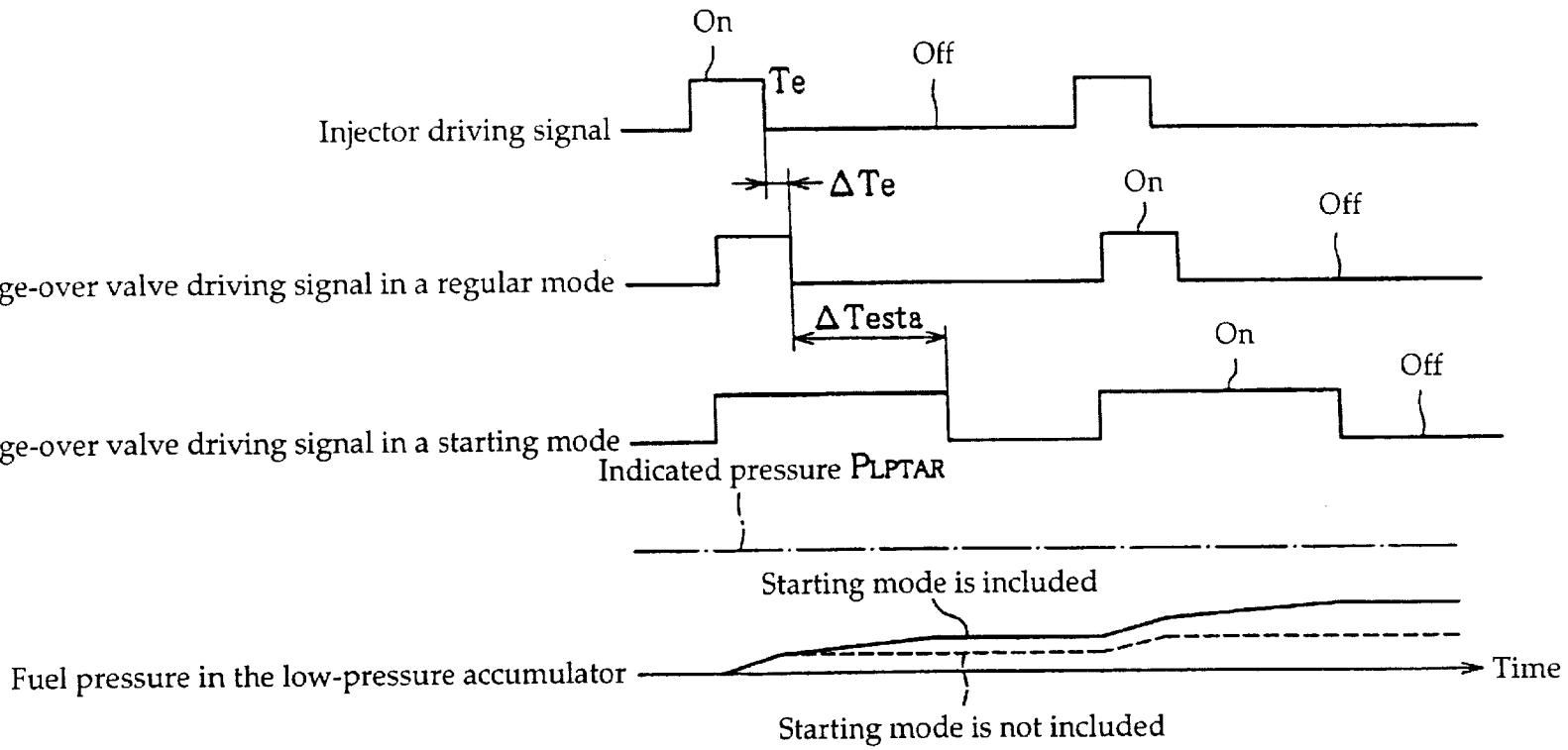
FIG. 8 is a diagram showing variations of an injector driving signal, a change-over valve driving signal and a fuel pressure in a low-pressure accumulator with the lapse of time during a fuel injection control operation in a starting mode in the second embodiment and variation of a change-over valve driving signal in a regular mode.

When the fuel injection finishing time has come, the injection time control switch valve 7 is closed, and the high-pressure fuel supplied to the control chamber 11 works on the needle valve 13 via the hydraulic piston 14, so that the needle valve 13 closes the nozzle port of the injector 9. At the fuel injection finishing time, the fuel injection rate falls speedily to contribute to a decrease in the rates of discharge of black smoke and particulates (PM) from the engine. The injection rate switching change-over valve 5 is closed simultaneously with the closure of the switch valve 7 at the fuel injection finishing time Te, or at a point in time at which a predetermined time (shown by a symbol ΔTe in FIG. 8) has elapsed after the fuel injection finishing time.

Figure 4:
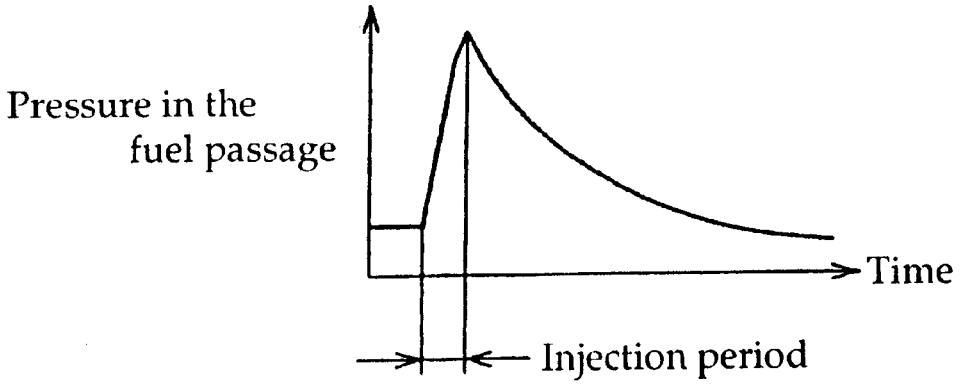
FIG. 4 is a diagram showing variation of a fuel pressure in the portion of a fuel passage which is between an injector and a control valve with the lapse of time in one fuel injection cycle executed in a regular mode.

As shown in FIG. 4, the fuel pressure in the portion of the fuel passage 10*a* which is between the injector 9 and injection rate switching change-over valve 5 gradually decreases from a point in time at which the fuel injection in each fuel injection cycle finishes, to a level, which suits low-pressure injection, by the time when the fuel injection in a subsequent fuel injection cycle is started, and the injection rate in a subsequent low-pressure injection operation reaches a required level.

When the operation of the engine is stopped, the fuel in the fuel passages 10*a*, 10*b* gradually flows out via a clearance around the control chamber 11 of the injector 9 and a clearance around the plunger of the high-pressure pump 1, and the fuel pressure in the fuel passages 10*a*, 10*b* and low-pressure accumulator 4 decreases to a level corresponding to that of the atmospheric pressure.

As has already been described, when the fuel injection at the engine starting time, after the operation of the engine was once stopped, is executed in the same manner as that in the above-mentioned case of a regular mode, the formation of a fuel pressure in, especially, the low-pressure accumulator 4 is delayed, and it is difficult to obtain immediately a low-pressure fuel of a predetermined level exceeding the pressure for opening the injector 9. Therefore, the low-pressure injection is not executed, and the fuel injection starting time is delayed to cause inconveniences including imperfect starting of the engine to occur.

Therefore, in the accumulator type fuel injection system according to the present invention, fuel injection in a starting mode different from the above-mentioned regular mode is executed at the engine starting time to promote the formation of a fuel pressure in the low-pressure accumulator, and enable the fuel injection in a regular mode to be executed early.

A concrete example (first embodiment) in which this starting mode is effected by promoting the formation of a fuel pressure in the low-pressure accumulator at the engine starting time will now be described.

Figure 5:
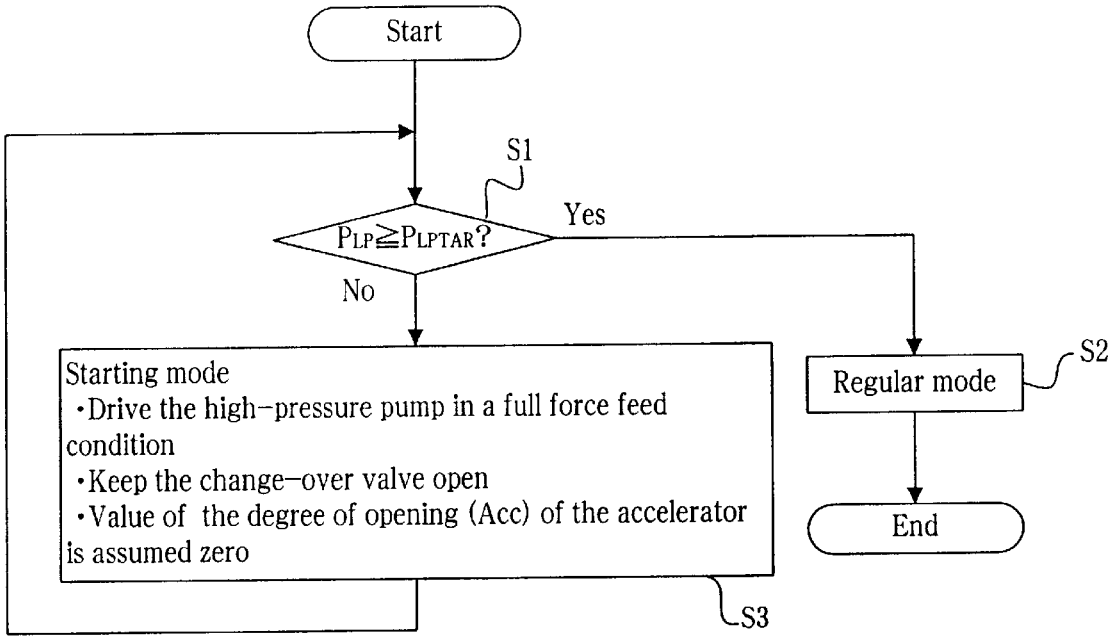
FIG. 5 is a flow chart of a fuel injection mode judgement routine in a first embodiment of the present invention.

When a power source is turned on at the engine starting time, the controller 8 executes the fuel injection mode judgement routine shown in FIG. 5 in a predetermined cycle.

In this judgement routine, a target value (indicated value) $P_{LPRAR}$ of the low-pressure fuel which suits the operating condition of the engine is determined with reference to, for example, a map (not shown) of operating condition of an engine and indicated value of low-pressure fuel on the basis of, for example, engine speed Ne and accelerator pedal stepping amount $A_{CC}$. An output $P_{LP}$, which is representative of the fuel pressure in the low-pressure accumulator 4, from the pressure sensor 4*a* is read, and an actual pressure value of the low-pressure fuel is detected. This actual pressure value $P_{LP}$ is then judged (Step S1) as to whether it has reached the indicated level $P_{LPTAR}$.

When the result of the judgement in Step S1 is affirmative (Yes), the formation of a fuel pressure in the low-pressure accumulator 4 has been completed, the procedural action is transferred (Step S2) to the fuel injection in a regular mode, to finish the execution of the judgement routine of FIG. 5.

When the result of the judgement in Step S1 is negative (No), the formation of a fuel pressure in the low-pressure accumulator 4 has not been completed. When fuel injection in a regular mode is executed, there is a fear of occurrence of inconveniences, such as imperfect start of the engine as mentioned above, fuel injection in a starting mode is executed (Step S3).

In the starting mode, the high-pressure pump 1 is driven in a full force feed condition. Namely, the high-pressure pump 1 is driven with the effective section of a force feed stroke set maximal. The injection rate switching change-over valve 5 is always kept open. A value "zero" is set (FIG. 6) instead of an actual value (value of an output signal from the sensor) detected by the degree of opening of accelerator sensor (not shown), as the accelerator pedal stepping amount (degree of opening of the accelerator) $A_{CC}$ which is used with the engine speed Ne for setting a fuel injection rate, fuel injection time and target fuel pressures in the accumulators 3, 4.

Therefore, when the cranking for the starting of the engine is started, the starting mode is selected in the judgement routine of FIG. 5 since the formation of a fuel pressure in the low-pressure accumulator 4 is insufficient at this point in time. Consequently, the driving of the pump in a full force feed condition is started simultaneously with the starting of the cranking operation, to start the supplying of a pressurized fuel from the high-pressure pump 1 to the high-pressure accumulator 3. A change-over valve driving signal supplied to the injection rate switching change-over valve 5 is always put in an ON-state, whereby the change-over valve 5 is always kept open. Accordingly, the pressurized fuel in the high-pressure accumulator 3 is supplied to the fuel passage 10*a*, and this pressurized fuel is capable of being supplied to the control chamber 11 and fuel chamber 12 of the injector 9. Since the high-pressure pump 1 is driven in a full force feed condition, the formation of a fuel pressure in the high-pressure accumulator 3 is promoted.

Since the accelerator pedal stepping amount $A_{CC}$ is set to a value "zero" in a starting mode, the injection time control switch valve 7 is driven by an injector driving signal at such valve opening and closing time that permits a fuel injection time and period which suit the idling of the engine to be attained. As a result, the pressurized fuel in the fuel chamber 12 supplied from the high-pressure accumulator 3 via the fuel passage 10*a* is injected from the nozzle port of the injector 9 while the switch valve 7 is opened. Namely, in the starting mode, the fuel injection is executed at substantially the same injection rate throughout the whole of the injection period. Accordingly, the fuel injection is started at a desired injection starting time, so that an injection delay, which is ascribed to the non-execution of low-pressure injection occurring when fuel injection is executed in a regular mode, is prevented despite the incompletion of the formation of a fuel pressure in the low-pressure accumulator 4.

Since a fuel of a comparatively high pressure supplied from the high-pressure accumulator 3 is injected in the starting mode as mentioned above, there is the possibility that a combustion sound and the deterioration of the exhaust gas characteristics occur as compared with the case where fuel injection is carried out in a regular mode. However, when the idling condition is maintained by setting the accelerator pedal stepping amount $A_{CC}$ to a value "zero", the fuel consumption decreases, so that it becomes possible to reduce the number of times of combustion carried out until the fuel pressure in the low-pressure accumulator 4 has attained a set level, and prevent the occurrence of a combustion sound and the deterioration of the exhaust gas characteristics.

Figure 6:
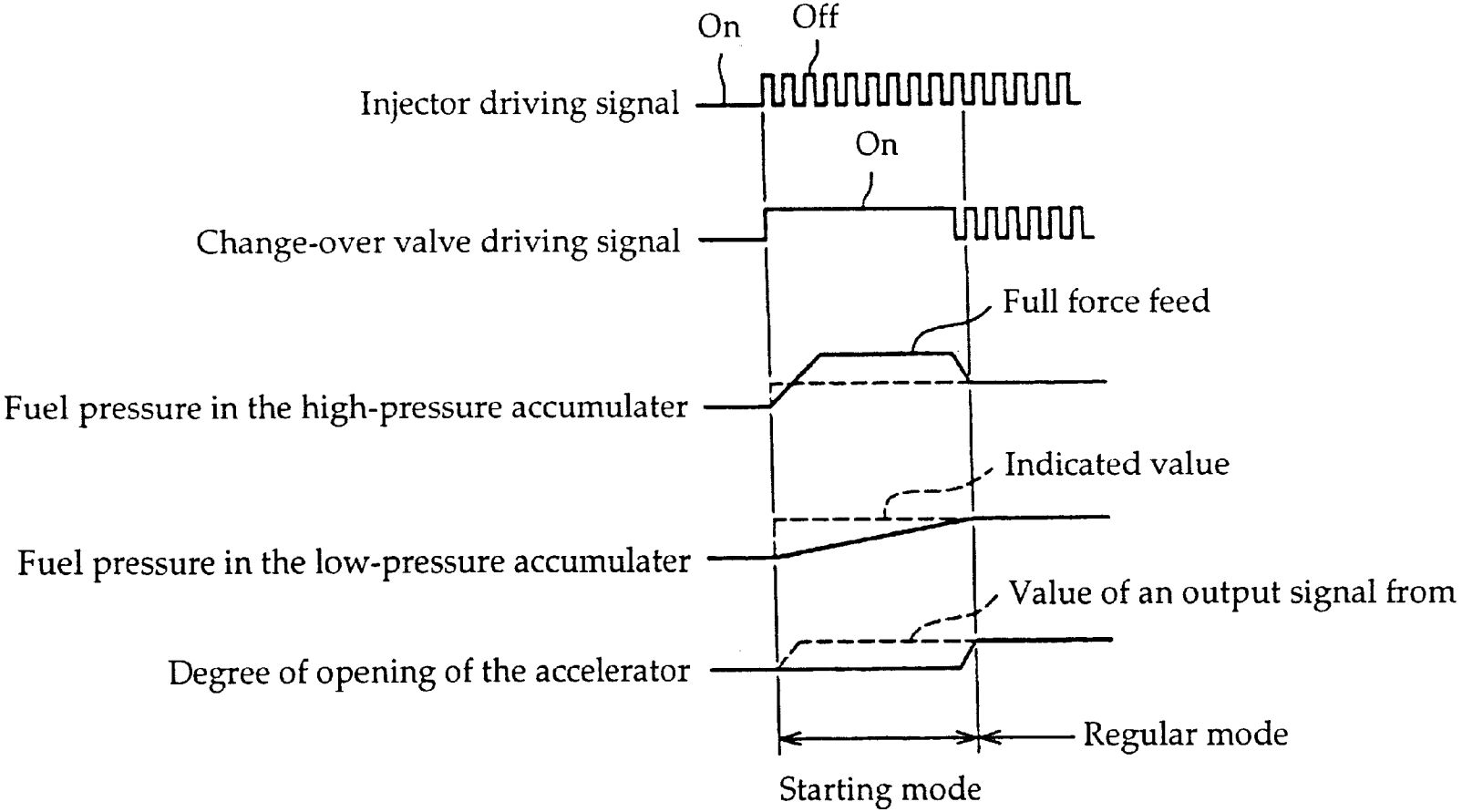
FIG. 6 is a diagram showing variations of an injector driving signal, a change-over valve driving signal, a fuel pressure in a high-pressure accumulator, a fuel pressure in a low-pressure accumulator and a degree of opening of an accelerator with the lapse of time during a fuel injection control operation in a starting mode in the first embodiment.

The change-over valve 5 is always kept open in a starting mode unlike that in the regular mode, so that the pressurized fuel from the high-pressure accumulator 3 is always supplied to the low-pressure accumulator 4 via the fuel passage 10*a* and orifice 6*a*. Especially, in a period of time other than the fuel injection time, the supply of the pressurized fuel to the low-pressure accumulator 4 is done positively. Owing to this effect in the starting mode as well as the characteristics that the pressure of the pressurized fuel supplied via the fuel passage 10*a* and orifice 6*a* is increased by driving the high-pressure pump 1 in a full force feed condition and thereby increasing the pressure of the pressurized fuel supplied from the high-pressure accumulator 3 to the fuel passage 10*a*, the formation of a fuel pressure in the low-pressure accumulator 4 is promoted, and the fuel pressure in the low-pressure accumulator 4 increases rapidly with the lapse of time as shown in FIG. 6.

When the formation of a pressure in the low-pressure accumulator 4 is thus completed in a short period of time, a judgement that the actual pressure value $P_{LP}$ in the low-pressure accumulator 4 has exceeded the indicated value $P_{LPTAR}$ in Step S1 of the judgement routine of FIG. 5 is given. In this case, the fuel injection in the starting mode is transferred to fuel injection in a regular mode.

Another concrete example (second embodiment) which can be attained by promoting the formation of a pressure in the low-pressure accumulator at the engine starting time will now be described.

The system of the second embodiment is identical with that of the first embodiment in that the promotion of the formation of a fuel pressure in the low-pressure accumulator at the engine starting time is intended, and different therefrom in that the injection rate switching change-over valve 5, which is always kept open in the starting mode in the first embodiment, is opened intermittently.

Figure 7:
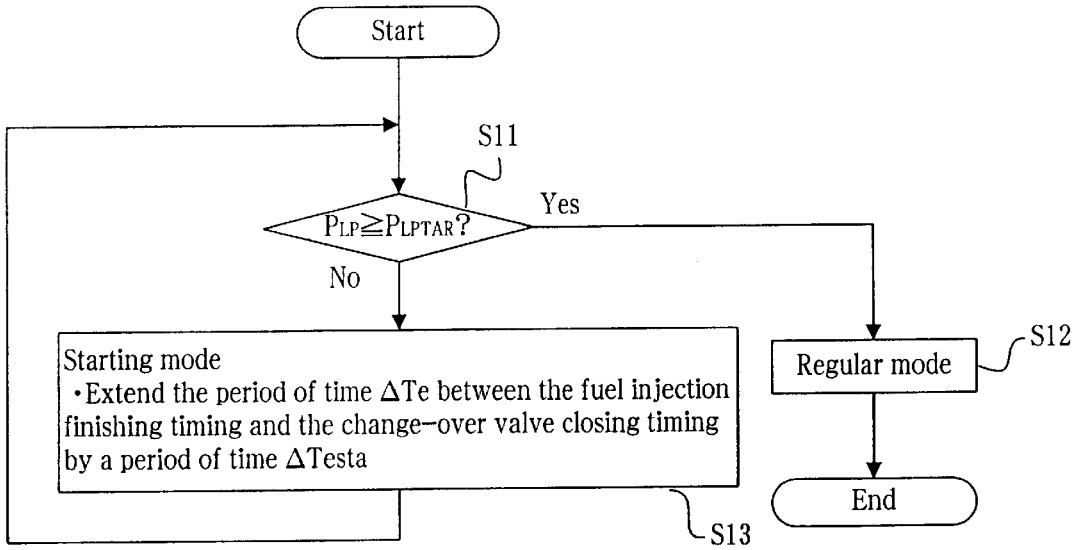
FIG. 7 is a flow chart of a fuel injection mode judgement routine in a second embodiment of the present invention.

Regarding these characteristics, a judgement routine shown in FIG. 7 instead of the fuel injection mode judgement routine of FIG. 5 related to the first embodiment is executed in the second embodiment. The remaining portions of the second embodiment are substantially identical with those of the first embodiment, and the descriptions thereof will be omitted.

In the fuel injection mode judgement routine of FIG. 7, a target pressure value (indicated value) $P_{LPTAR}$ of a low-pressure fuel which suits the operating condition of the engine is determined in the same manner as in the case of the routine of FIG. 5, and an actual value $P_{LP}$ of the fuel pressure in the low-pressure accumulator 4 is judged (Step S11) as to whether it has reached the indicated level. When the result of this judgement is affirmative, fuel injection in a regular mode is executed (Step S12).

When a judgement that the fuel pressure in the low-pressure accumulator 4 has not reached the indicated level is given in Step S1, fuel injection in a starting mode is executed (Step S13). In the fuel injection in the starting mode, the length of the time during which the injection rate switching change-over valve 5 is opened is set long as compared with that in the case of the fuel injection in the regular mode. In the second embodiment, a predetermined period of time ΔTe between the fuel injection finishing time (instant at which the injector driving signal falls) and the change-over valve opening time (instant at which the change-over valve driving signal falls) is extended by extension time ΔTesta.

When the cranking for the start of the engine is started, a starting mode is selected in the judgement routine of FIG. 7, and the driving of a high-pressure pump 1 is started. A pressurized fuel from the high-pressure pump 1 is supplied to a high-pressure accumulator 3, from which the pressurized fuel is further supplied to a fuel passage 10*a* and a low-pressure accumulator 4.

In the starting mode, an injection time control switch valve 7 is driven with this valve opened and closed so that a fuel injection period suiting the operating condition of the engine is obtained, and, while the switch valve 7 is opened, the pressurized fuel in a fuel chamber 12 is injected from a nozzle port of an injector 9.

In the starting mode in this embodiment, the opening of the injection rate switching change-over valve 5 is timed in the same manner as in a regular mode. In the starting mode, the change-over valve 5 may be opened simultaneously with the switch valve 7 for the purpose of preventing the injection delay ascribed to the imperfect formation of fuel pressure in the low-pressure accumulator 4.

In the starting mode, the time, unlike that in a regular mode, at which the change-over valve 5 is opened is extended by ΔTesta. Accordingly, the time during which the pressurized fuel is supplied from the high-pressure accumulator 3 to the low-pressure accumulator 4 via the fuel passage 10*a* and an orifice 6*a* is long, and, especially, in a part of a period other than the fuel injection period, the supplying of the pressurized fuel to the low-pressure accumulator 4 is done positively. Therefore, in the starting mode, the formation of fuel pressure in the low-pressure accumulator 4 is promoted, and a rate of increase of the fuel pressure in the low-pressure accumulator 4 becomes large as shown by a solid line in FIG. 8, as compared with a case (broken line) where the formation of fuel pressure in the starting mode is not executed.

When a judgement that an actual value in the low-pressure accumulator 4 has exceeded the indicated level, i.e., the formation of fuel pressure in the low-pressure accumulator 4 has been completed is given in Step S11 in the judgement routine of FIG. 7, the fuel injection is transferred to fuel injection in a regular mode.

When an actual value of the fuel pressure in the low-pressure accumulator 4 has reached the indicated level in a certain fuel injection cycle as mentioned above, the fuel pressure in the fuel passage 10*a* decreases to a level, which corresponds to the fuel injection pressure in a low-pressure injection operation in a regular mode, between the time at which the change-over valve 5 is closed after the completion of this fuel injection cycle and the time at which a subsequent fuel injection cycle is started. Therefore, the low-pressure injection is carried out smoothly even in a fuel injection cycle executed for the first time after the fuel injection mode has been transferred to a regular mode.

In this embodiment, the change-over valve 5 comprises a two-way electromagnetic valve, which is typically so formed that it is opened when an electric current is applied thereto. Namely, a normally-closed type electromagnetic valve is used. In this case, the time during which the change-over valve 5 is opened is extended, not kept open at all times, in the starting mode in this embodiment as compared with that in the regular mode, so that the electromagnetic valve constituting the change-over valve 5 is closed intermittently. Accordingly, the application of an electric current to the electromagnetic valve is not continuously carried out, so that the durability of the electromagnetic valve is improved as compared with that of an electromagnetic valve to which an electric current is applied continuously. Since it is unnecessary to form the electronic valve so that it withstands the heat occurring due to the continuous application of electric current, i.e., since the thermal requirements for the electronic valve are lightened, the electromagnetic valve can be formed inexpensively.

The present invention is not limited to the first and second embodiments, and can be modified variously.

For example, in the second embodiment, the opening time of the injection rate switching change-over valve 5 is extended in the time region after the fuel injection finishing time. This opening time may also be extended in the time region before the fuel injection starting time.

In the second embodiment, the accelerator pedal stepping amount $A_{CC}$ may be set to "zero" while the fuel injection is carried out in a starting mode, in the same manner as in the first embodiment.

In the first and second embodiments, the actual value of the fuel pressure in the low-pressure accumulator 4 is judged as to whether it has reached an indicated level (set pressure) $P_{LPTAR}$ or not, on the basis of an output $P_{LP}$ from the pressure sensor 4*a* fixed to the low-pressure accumulator (second accumulator) 4. The attainment of the set pressure may also be judged on the basis of the length of time elapsed after the engine starting time or the engine speed.

A concrete example (third embodiment) for rationalizing the fuel injection starting time at the engine starting time will now be described. In this embodiment, a starting mode is formed on the basis of a logic different from that on which the starting mode of the first and second embodiments is based. Since the remaining portions of the third embodiment are substantially identical with those of the first and second embodiments, the descriptions thereof will be omitted.

Figure 9:
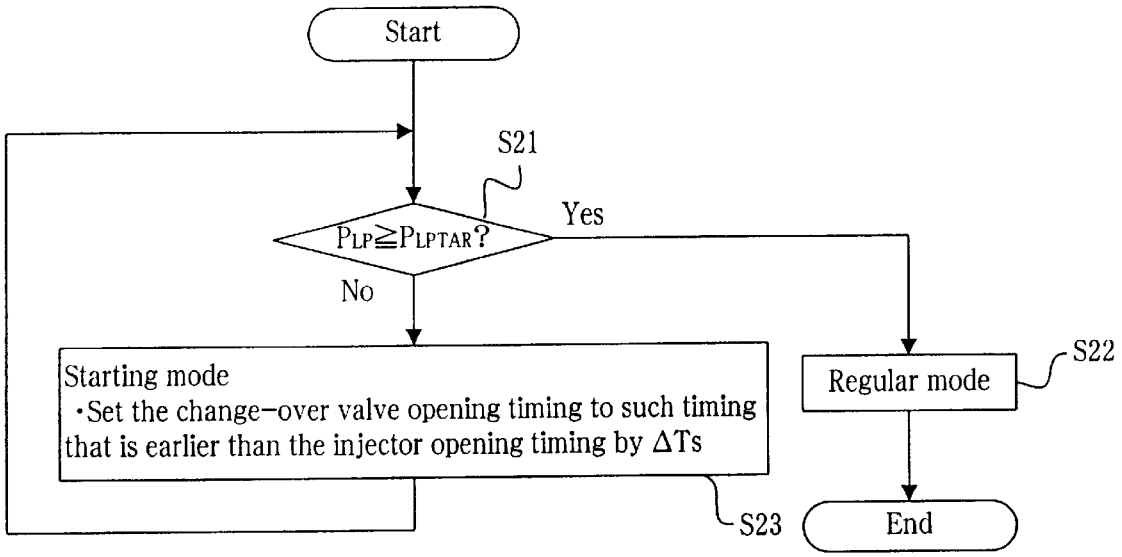
FIG. 9 is a flow chart of a fuel injection mode judgement routine in a third embodiment of the present invention.

When a power source is turned on at the engine starting time in this embodiment, a controller 8 executes in a predetermined cycle a fuel injection mode judgement routine shown in FIG. 9.

In this judgement routine, a target value (indicated value) $P_{LPTAR}$ of a low-pressure fuel which suits the operating condition of the engine is determined with reference to, for example, an operating condition of engine and low-pressure fuel indicated value map (not shown) on the basis of, for example, an engine speed Ne and an accelerator pedal stepping amount $A_{CC}$. An output $P_{LP}$ from a pressure sensor 4*a* which represents a fuel pressure in a low-pressure accumulator 4 is read, and an actual pressure value of the low-pressure fuel is detected. The actual pressure value $P_{LP}$ is judged (Step S21) as to whether it has reached the indicated level $P_{LPTAR}$ or not.

When the result of the judgement in Step S21 is affirmative (Yes), the formation of fuel pressure in the low-pressure accumulator 4 has been completed, so that the procedural action is transferred (Step S22) to the fuel injection in the above-mentioned regular mode to finish the execution of the judgement routine of FIG. 9.

When the result of the judgement in Step S21 is negative (No), the formation of fuel pressure in the low-pressure accumulator 4 has not been completed. When fuel injection in a regular mode is executed in this case, there is a fear of occurrence of inconveniences, such as imperfect engine starting, as mentioned above, and, therefore, fuel injection in a starting mode is executed (Step S23).

Figure 10:
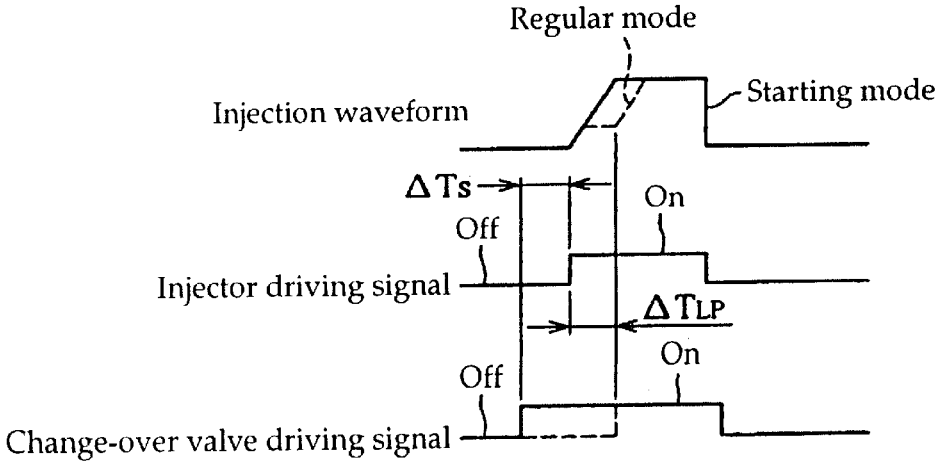
FIG. 10 is a diagram showing variations of an injection waveform, an injector driving signal and a change-over valve driving signal with the lapse of time during a fuel injection control operation at the start of the engine in the third embodiment.

In the starting mode, the injector opening period (opening starting and finishing time) is set in the same manner as that in a regular mode, and the opening starting time of an injection rate switching change-over valve 5 is set to time earlier than that in a regular mode. In this embodiment, the opening starting time of the change-over valve 5 is set to time earlier than that (target fuel injection starting time) of the injector 9 by a period of time ΔTs as shown in FIG. 10. Namely, the opening starting time of the change-over valve 5 is set to time earlier than that (shown by a broken line) in a regular mode by a period of time equal to the sum of ΔTs and a low-pressure injection period of time $\Delta T_{LP}$.

When a change-over valve driving signal is applied from the controller 8 to the change-over valve 5 on the arrival of the opening starting time thereof in each fuel injection cycle in a starting mode, the change-over 5 is opened. As a result, the pressurized fuel in a high-pressure accumulator 3 is supplied to a control chamber 11 and a fuel chamber 12 of the injector 9 via a fuel passage 10*a*. When the target fuel injection starting time has come with the time ΔTs having elapsed after the opening starting time of the change-over valve 5, an injector driving signal is applied from the controller 8 to a switch valve 7, so that the switch valve 7 is opened to cause the pressurized fuel in the control chamber 11 to drain away, and a needle valve 13 of the injector 9 to be lifted. As a result, a nozzle port is opened, and the pressurized fuel supplied to the fuel chamber 12 is injected. As described above, even in a starting mode, the opening time (target fuel injection starting time) of the switch valve 7 is set so that it suits the operating condition of the engine. Therefore, when fuel injection is started simultaneously with the opening of the switch valve 7 as mentioned above, the fuel injection starting time comes to suit the operating condition of the engine. Accordingly, an injection delay ascribed to the non-execution of low-pressure injection which occurs when fuel injection is executed in a regular mode in spite of the insufficient formation of fuel pressure in the low-pressure accumulator 4 is prevented.

When the formation of fuel pressure in the low-pressure accumulator 4 has been completed, a judgement that the actual pressure value $P_{LP}$ in the low-pressure accumulator 4 has exceeded the indicated level $P_{LPTAR}$ is given in Step S21 of the judgement routine of FIG. 9. In this case, the fuel injection in the starting mode is transferred to the fuel injection in a regular mode.

When the actual value $P_{LP}$ of the fuel pressure in the low-pressure accumulator 4 has reached the indicated level $P_{LPTAR}$ in a certain fuel injection cycle as mentioned above, the fuel pressure in the fuel passage 10*a* decreases to a level corresponding to the fuel injection pressure in the low-pressure injection in the regular mode between the time at which the change-over valve 5 is closed after the completion of this fuel injection cycle and the time at which a subsequent fuel injection cycle is started. Therefore, the low-pressure injection is carried out smoothly even in a fuel injection cycle executed for the first time after the fuel injection in the starting mode has been transferred to the fuel injection in a regular mode.

Another concrete example (fourth embodiment) in which the fuel injection starting time at the engine starting time is rationalized will now be described.

The system of the fourth embodiment is identical with that of the third embodiment in that the prevention of a fuel injection starting delay at the start of the engine is intended, and different therefrom in that the opening periods of both an injector 9 and a change-over valve 5 are set equal to those in a regular mode with the opening starting times thereof set to time earlier than those in a regular mode, though, in the system of the third embodiment, the opening period (opening starting and finishing time) of the injector is set to the same level as in the case of a regular mode with the opening starting time of the change-over valve 5 set to early time.

Figure 11:
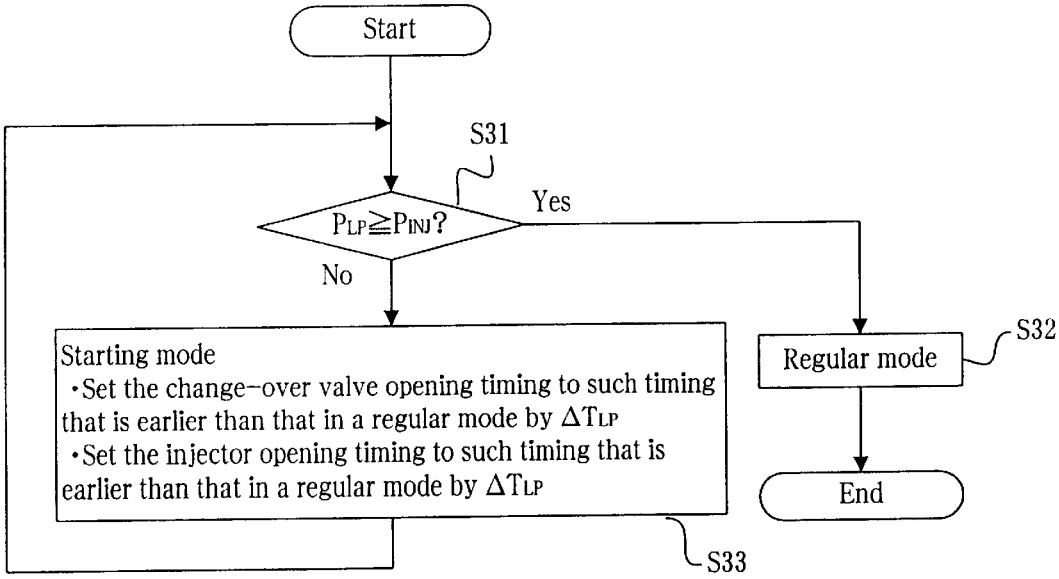
FIG. 11 is flow chart of a fuel injection mode judgement routine in a fourth embodiment of the present invention.

Regarding these characteristics, a judgement routine shown in FIG. 11 is executed in the fourth embodiment instead of the fuel injection mode judgement routine of FIG. 9 related to the third embodiment. The remaining portions of the fourth embodiment are substantially identical with those of the first to third embodiments, and the descriptions thereof will be omitted.

In the fuel injection mode judgement routine of FIG. 11, an injector opening pressure (injection executable pressure) $P_{INJ}$ determined on the basis of a set load of a spring imparted to a hydraulic piston 14 of the injector 9 is read from a storage unit in a controller 8 to judge (Step S31) whether an actual value PLP of the fuel pressure in a low-pressure pressure accumulator 4 has reached the injector opening pressure $P_{INJ}$ or not. When the result of the judgement is affirmative, the fuel injection in a regular mode is executed (Step S32).

When a judgement that the actual value of the fuel pressure in the low-pressure accumulator 4 has not reached the injector opening pressure $P_{INJ}$ is given in Step S31, the fuel injection in a starting mode is executed (Step S33). In the starting mode, the opening starting time of the injector 9 and change-over valve 5 in accordance with the operating condition of the engine and a low-pressure injection period $\Delta T_{LP}$ are determined with reference to a map (not shown) in the same manner as in the case of a regular mode. Both the injector opening time and change-over valve opening time are corrected to the side of early time by using the low-pressure injection period $\Delta T_{LP}$.

Figure 12:
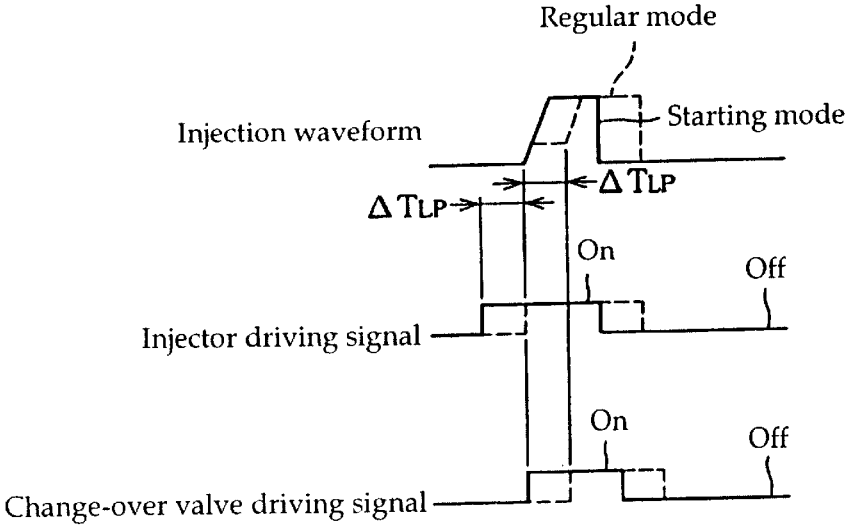
FIG. 12 is a diagram showing variations with the lapse of time of an injection waveform, an injector driving signal and a change-over driving signal with the lapse of time in a fuel injection control operation at the starting of an engine in the fourth embodiment.

Accordingly, when the injector opening starting time corrected to the time earlier than the injector opening starting time in a regular mode by the low-pressure injection period $\Delta T_{LP}$ has come in a starting mode as shown in FIG. 12, an injection time control switch valve 7 is opened. The formation of fuel pressure in the low-pressure accumulator 4 is insufficient in this case, so that the fuel pressure supplied to a fuel chamber 12 of the injector 9 is smaller than the set load of a spring imparted to the hydraulic piston 14. Therefore, the injector 9 is kept closed.

When the change-over valve opening starting time corrected to the time earlier than that in a regular mode by the length of the low-pressure injection period $\Delta T_{LP}$ has then come, the injection rate switching change-over valve 5 is opened. As a result, the pressurized fuel in a high-pressure accumulator 3 is supplied to the fuel chamber 12 via a fuel passage 10*a*, and the fuel pressure in the fuel chamber 12 exceeds the injector opening pressure to cause the pressurized fuel to be injected from a nozzle port. After all, in the starting mode, the fuel injection is started at such time that substantially agrees with the low-pressure injection starting time in a regular mode. In other words, when a fuel injection control operation in a starting mode in which the opening starting time of the injector and change-over valve is corrected to earlier time is carried out, an injection delay ascribed to the non-execution of low-pressure injection occurring in a case where fuel injection is executed in the regular mode is prevented in spite of the insufficient formation of fuel pressure in the low-pressure accumulator 4.

When the formation of fuel pressure in the low-pressure accumulator 4 has sufficiently progressed, a judgement that the actual value in the low-pressure accumulator 4 has exceeded the injection executable pressure level is given in Step S31 of the judgement routine of FIG. 11, and the fuel injection is transferred to fuel injection in the regular mode.

The present invention is not limited to the above-described third and fourth embodiments, and it can be modified variously.

For example, in the third and fourth embodiments, the actual value of the fuel pressure in the low-pressure accumulator 4 is judged as to whether it has reached the indicated level (set pressure) $P_{LPTAR}$ or the injection executable pressure level $P_{INJ}$, on the basis of an output $P_{LP}$ from a pressure sensor 4*a* fixed to the low-pressure accumulator (second accumulator) 4, and the attainment of the set level or injection executable pressure level may also be judged on the basis of the length of time elapsed after the point in time at which the engine was started or the engine speed.

What is claimed is:

1. An accumulator type fuel injection system comprising:

a first accumulator adapted to store a high-pressure fuel pressurized by a pump;

a fuel injection nozzle connected to said first accumulator via a fuel passage and adapted to inject the fuel into a combustion chamber of an engine;

a control valve adapted to control the discharging of the high-pressure fuel in said first accumulator to a downstream portion of said fuel passage;

a second accumulator adapted to store a fuel the pressure of which is lower than that of the high-pressure fuel in said first accumulator, and connected via a branch passage to a portion of said fuel passage which is on a downstream side of said control valve; and a fuel control device adapted to open said control valve for a period of time, not shorter than a period of time during which said fuel injection nozzle is opened, until a fuel pressure in said second accumulator has reached a set level, open said control valve during a period of time during which said fuel injection nozzle is opened, and close said control valve simultaneously with the closure of said fuel injection nozzle, after the fuel pressure in said second accumulator has reached said set level.

2. An accumulator type fuel injection system according to claim 1, wherein said fuel control device is adapted to open said control valve continuously until the fuel pressure in said second accumulator has reached the set level.

3. An accumulator type fuel injection system according to claim 1, wherein said fuel control device is adapted to open said control valve in accordance with the opening of said fuel injection nozzle until the fuel pressure in said second accumulator has reached the set level, and close said control valve later than the closing time of said fuel injection nozzle.

4. An accumulator type fuel injection system according to claim 1, wherein said fuel control device is adapted to set a fuel discharge pressure of said pump to a level higher than the set level of the fuel pressure in said first accumulator.

5. An accumulator type fuel injection system according to claim 1, wherein said fuel control device is adapted to maintain the idling condition of said engine in preference to a driver's accelerator pedal stepping operation until the fuel pressure in said second accumulator has reached the set level.

6. An accumulator type fuel injection system comprising:

a first accumulator adapted to store a high-pressure fuel pressurized by a pump;

a fuel injection nozzle connected to said first accumulator via a fuel passage and inject a fuel into a combustion chamber of an engine;

a control valve adapted to control the discharging of the high-pressure fuel in said first accumulator to a downstream portion of said fuel passage;

a second accumulator connected via a branch passage to a portion of said fuel passage which is on a downstream side of said control valve, and adapted to store a fuel the pressure of which is lower than that of the high-pressure fuel in said first accumulator; and a fuel control device adapted to open said control valve when a predetermined period of time has elapsed after the opening of said fuel injection nozzle, close said control valve simultaneously with the closure of said fuel injection nozzle, after the fuel pressure in said second accumulator has reached a predetermined level after the starting of said engine, and open said control valve at such timing that is simultaneously with or earlier than a target fuel injection starting time set in accordance with an operating condition of said engine, until the fuel pressure in said second accumulator has reached said predetermined level.

7. An accumulator type fuel injection system according to claim 6, wherein said fuel control device is adapted to open said fuel injection nozzle at said target fuel injection starting time, and open said control valve at such time that is earlier than said target fuel injection starting time.

8. An accumulator type fuel injection system according to claim 6, wherein said predetermined pressure is a set pressure relating to the fuel pressure in said second accumulator and set in accordance with the operating condition of said engine.

9. An accumulator type fuel injection system comprising:

a first accumulator means for storing a high-pressure fuel pressurized by a pump;

a fuel injection means connected to said first accumulator means via a fuel passage for injecting the fuel into a combustion chamber of an engine;

a control valve means for controlling the discharge of the high-pressure fuel in said first accumulator means to a downstream portion of said fuel passage;

a second accumulator means for storing a fuel the pressure of which is lower than that of the high-pressure fuel in said first accumulator means, wherein the second accumulator means is connected via a branch passage to a portion of said fuel passage which is on a downstream side of said control valve means, and a fuel control means for opening said control valve means for a period of time not shorter than a period of time during which said fuel injection means is opened, until a fuel pressure in said second accumulator means has reached a set level, opening said control valve means during a period of time during which said fuel injection means is opened, and closing said control valve means simultaneously with the closure of said fuel injection means, after the fuel pressure in said second accumulator means has reached said set level.

10. An accumulator type fuel injection system according to claim 9, wherein said fuel control means opens said control valve means continuously until the fuel pressure in said second accumulator means has reached the set level.

11. An accumulator type fuel injection system according to claim 9, wherein said fuel control means opens said control valve means in accordance with the opening of said fuel injection means until the fuel pressure in said second accumulator means has reached the set level, and closes said control valve means later than the closing time of said fuel injection means.

12. An accumulator type fuel injection system according to claim 9, wherein said fuel control means sets a fuel discharge pressure of said pump to a level higher than the set level of the fuel pressure in said first accumulator means.

13. An accumulator type fuel injection system according to claim 9, wherein said fuel control means maintains the idling condition of said engine in preference to a driver's accelerator pedal stepping operation until the fuel pressure in said second accumulator means has reached the set level.

14. An accumulator type fuel injection system comprising:

a first accumulator means for storing a high-pressure fuel pressurized by a pump;

a fuel injection means for injecting a fuel into a combustion chamber of an engine, wherein the fuel injection means is connected to said first accumulator means via a fuel passage;

a control valve means for controlling the discharging of the high-pressure fuel in said first accumulator means to a downstream portion of said fuel passage;

a second accumulator means for storing a fuel the pressure of which is lower than that of the high-pressure fuel in said first accumulator means, wherein the second accumulator means is connected via a branch passage to a portion of said fuel passage which is on a downstream side of said control valve means; and a fuel control means for opening said control valve means when a predetermined period of time has elapsed after the opening of said fuel injection means, closing said control valve means simultaneously with the closure of said fuel injection means, after the fuel pressure in said second accumulator means has reached a predetermined level after the starting of said engine, and opening said control valve means at such timing that is simultaneously with or earlier than a target fuel injection starting time set in accordance with an operating condition of said engine, until the fuel pressure in said second accumulator means has reached said predetermined level.

15. An accumulator type fuel injection system according to claim 14, wherein said fuel control means opens said fuel injection means at said target fuel injection starting time, and opens said control valve means at such time that is earlier than said target fuel injection starting time.

16. An accumulator type fuel injection system according to claim 14, wherein said predetermined pressure is a set pressure relating to the fuel pressure in said second accumulator means and set in accordance with the operating condition of said engine.

17. A fuel injection method comprising:

storing a high-pressure fuel pressurized by a pump within a first accumulator means;

injecting the fuel into a combustion chamber of an engine with a fuel injection means which is connected to said first accumulator means via a fuel passage;

controlling the discharge of the high-pressure fuel in said first accumulator means to a downstream portion of said fuel passage with a control valve means;

storing within a second accumulator means a fuel the pressure of which is lower than that of the high-pressure fuel in said first accumulator means, wherein the second accumulator means is connected via a branch passage to a portion of said fuel passage which is on a downstream side of said control valve means; and opening said control valve means with a fuel control means for a period of time not shorter than a period of time during which said fuel injection means is opened, until a fuel pressure in said second accumulator means has reached a set level, opening said control valve means with the fuel control means during a period of time during which said fuel injection means is opened; and closing said control valve means with the fuel control means simultaneously with the closure of said fuel injection means, after the fuel pressure in said second accumulator means has reached said set level.

18. A fuel injection method according to claim 17, wherein said fuel control means opens said control valve means continuously until the fuel pressure in said second accumulator means has reached the set level.

19. A fuel injection method according to claim 17, wherein said fuel control means opens said control valve means in accordance with the opening of said fuel injection means until the fuel pressure in said second accumulator means has reached the set level, and closes said control valve means later than the closing time of said fuel injection means.

20. A fuel injection method according to claim 17, wherein said fuel control means sets a fuel discharge pressure of said pump to a level higher than the set level of the fuel pressure in said first accumulator means.

21. A fuel injection method according to claim 17, wherein said fuel control means maintains the idling condition of said engine in preference to a driver's accelerator pedal stepping operation until the fuel pressure in said second accumulator means has reached the set level.

22. A fuel injection method comprising:

storing a high-pressure fuel pressurized by a pump within a first accumulator means;

injecting a fuel into a combustion chamber of an engine with a fuel injection means, wherein the fuel injection means is connected to said first accumulator means via a fuel passage;

controlling the discharging of the high-pressure fuel in said first accumulator means to a downstream portion of said fuel passage with a control valve means;

storing within a second accumulator means a fuel the pressure of which is lower than that of the high-pressure fuel in said first accumulator means, wherein the second accumulator means is connected via a branch passage to a portion of said fuel passage which is on a downstream side of said control valve means; and opening said control valve means with a fuel control means when a predetermined period of time has elapsed after the opening of said fuel injection means, closing said control valve means with the fuel control means simultaneously with the closure of said fuel injection means, after the fuel pressure in said second accumulator means has reached a predetermined level after the starting of said engine, and opening said control valve means with a fuel control means at such timing that is simultaneously with or earlier than a target fuel injection starting time set in accordance with an operating condition of said engine, until the fuel pressure in said second accumulator means has reached said predetermined level.

23. A fuel injection method according to claim 22, wherein said fuel control means opens said fuel injection means at said target fuel injection starting time, and opens said control valve means at such time that is earlier than said target fuel injection starting time.

24. A fuel injection method according to claim 22, wherein said predetermined pressure is a set pressure relating to the fuel pressure in said second accumulator means and set in accordance with the operating condition of said engine.

* * * * *